US010989005B2

(12) United States Patent
Ruttley

(10) Patent No.: US 10,989,005 B2
(45) Date of Patent: Apr. 27, 2021

(54) DOWNHOLE TUBULAR MILLING APPARATUS, ESPECIALLY SUITABLE FOR DEPLOYMENT ON COILED TUBING

(71) Applicant: Abrado, Inc., Houston, TX (US)

(72) Inventor: David J. Ruttley, Marrero, LA (US)

(73) Assignee: ABRADO, INC., Broussard, LA (US)

( * ) Notice: Subject to any disclaimer, the term of this patent is extended or adjusted under 35 U.S.C. 154(b) by 365 days.

(21) Appl. No.: 15/758,985

(22) PCT Filed: Sep. 14, 2016

(86) PCT No.: PCT/US2016/051780
§ 371 (c)(1),
(2) Date: Mar. 9, 2018

(87) PCT Pub. No.: WO2017/053151
PCT Pub. Date: Mar. 30, 2017

(65) Prior Publication Data

US 2020/0232294 A1 Jul. 23, 2020

Related U.S. Application Data

(60) Provisional application No. 62/218,953, filed on Sep. 15, 2015.

(51) Int. Cl.
*E21B 29/00* (2006.01)

(52) U.S. Cl.
CPC ..... *E21B 29/005* (2013.01)

(58) Field of Classification Search
CPC ..... E21B 17/20; E21B 29/005; E21B 10/322; E21B 10/325
See application file for complete search history.

(56) References Cited

U.S. PATENT DOCUMENTS

| | | | | |
|---|---|---|---|---|
| RE21,824 E | | 6/1941 | Lowrey | |
| 2,651,362 A | * | 9/1953 | Storm | E21B 31/18 166/55.6 |
| 3,117,626 A | * | 1/1964 | Ringler | E21B 29/005 166/55.7 |
| 3,316,970 A | * | 5/1967 | Huitt | E21B 43/14 166/55.7 |
| 4,589,504 A | * | 5/1986 | Simpson | E21B 10/60 175/267 |

(Continued)

*Primary Examiner* — Shane Bomar
(74) *Attorney, Agent, or Firm* — Law Office of Jesse D. Lambert, LLC

(57) ABSTRACT

An apparatus for cutting and/or milling of tubulars in a wellbore, especially using coiled tubing. An elongated main body has a longitudinal bore, with a piston slidably positioned in the bore. The piston is connected to one or more operating arms which are rotatably connected to the main body. The connection between the piston and the operating arms may be a pinned connection or a geared connection, both of which provide for a positive connection between the piston and the operating arms. Cutter bases are connected to the cutter arms, with a number of cutters mounted to the cutter bases. Fluid flow down the coiled tubing and through the main body bore pushes the piston downwardly, opening the operating arms and cutter bases and permitting the apparatus to be pulled up into the lower end of a tubular string for cutting and/or milling.

12 Claims, 4 Drawing Sheets

(56) References Cited

U.S. PATENT DOCUMENTS 4,693,328 A * 9/1987 Furse ..... E21B 17/1014 175/275
5,402,856 A * 4/1995 Warren ..... E21B 10/32 175/263
5,765,640 A * 6/1998 Milne ..... E21B 17/1021 166/206
5,788,000 A * 8/1998 Maury ..... E21B 10/322 175/325.1
6,070,677 A * 6/2000 Johnston, Jr. ..... E21B 10/61 175/57
6,920,923 B1 7/2005 Pietrobelli et al.
9,797,240 B2 * 10/2017 Tunget ..... E21B 33/13
2002/0117333 A1 * 8/2002 Wallace ..... E21B 4/006 175/19
2002/0162659 A1 11/2002 Davis et al.
2005/0145417 A1 * 7/2005 Radford ..... E21B 7/00 175/57
2005/0274546 A1 * 12/2005 Fanuel ..... E21B 10/32 175/57
2008/0245532 A1 * 10/2008 Rhinehart ..... E21B 10/32 166/376
2008/0271892 A1 * 11/2008 Lynde ..... E21B 43/114 166/298
2009/0266544 A1 * 10/2009 Redlinger ..... E21B 47/00 166/298
2010/0243266 A1 * 9/2010 Soby ..... E21B 10/322 166/373
2011/0220357 A1 * 9/2011 Segura ..... E21B 29/005 166/298
2012/0325480 A1 * 12/2012 Schmidt ..... E21B 10/322 166/298
2013/0168076 A1 * 7/2013 Davis ..... E21B 10/322 166/55.8
2014/0096947 A1 4/2014 Colbert et al.
2014/0102719 A1 4/2014 Hallunbaek
2014/0124191 A1 * 5/2014 Hallundbæk ..... E21B 29/005 166/55.2
2014/0311729 A1 * 10/2014 Pasvandi ..... E21B 43/112 166/55.3
2015/0090494 A1 * 4/2015 Lazarev ..... G06K 19/0772 175/40
2015/0211315 A1 7/2015 Ruttley
2016/0010413 A1 * 1/2016 Stokes ..... E21B 29/005 166/298

* cited by examiner

DOWNHOLE TUBULAR MILLING APPARATUS, ESPECIALLY SUITABLE FOR DEPLOYMENT ON COILED TUBING

CROSS REFERENCE TO RELATED APPLICATIONS

This non-provisional patent application claims priority to U.S. provisional patent application Ser. No. 62/218,953, filed Sep. 15, 2015, for all purposes. The disclosure of that provisional patent application is incorporated herein, to the extent not inconsistent with this application.

BACKGROUND

Field of the Invention

The apparatus embodying the principles of the present invention is used in connection with the cutting and/or milling of tubulars downhole, typically those in oil and gas wells ("wells"). In particular, the apparatus may be used to mill a section of a tubular, such as a casing string, where the casing string has a downwardly-facing end at some depth in the wellbore.

As is known in the art, very significant operational and cost savings may frequently be made when operations can be carried out with a workstring comprising coiled tubing, as opposed to a workstring comprising jointed tubulars. However, prior art casing cutting and/or milling tools exhibit various limitations when deployed on coiled tubing.

SUMMARY OF THE INVENTION

Apparatus embodying the principles of the present invention, and related methods of use of same, comprise an elongated main body comprising a means for attaching the apparatus to other downhole components, and ultimately to a workstring for lowering it into a wellbore, particularly (although not exclusively) wherein the workstring is a coiled tubing string. A piston, usually with a bore therethrough, is slidably disposed in a longitudinal bore within the main body. A spring, which may be a coil spring or other suitable spring means, biases the piston in an uphole direction. Fluid flow through the bore of the tubular workstring, and the bore of the main body, bears on the piston, with some of the fluid flowing through the piston bore. Sufficient fluid flow bearing on the face of the piston, and through the piston bore, can overcome the uphole force generated by the spring, and force the piston downward (in a downhole direction). An interchangeable jet may be positioned in the bore of the piston to control fluid flow therethrough.

The piston is connected to one or more operating arms, by a pin-type connection (or alternatively a gear type arrangement), such that the operating arms must move when the piston moves, either upward or downward. The operating arms are in turn rotatably connected to the main body, so that when the piston moves downhole, the operating arms are forced to rotate outwardly (extend outwardly). The operating arms are connected to a plurality of elongated cutter bases, and rotation of the operating arms outwardly in turn moves the plurality of cutter bases radially outward. Preferably, the cutter bases are connected to the main body by at least one more set of rotating link members, of substantially equal length to the operating arms, thereby maintaining the cutter bases in a position substantially parallel to the main body.

A plurality of cutters are attached to the cutter bases, by means known in the art. The cutters comprise a hardened cutting surface which is adapted to the milling and/or cutting of the tubular in the wellbore. Preferably, a section of the cutter bases on the upper or uphole end of the cutter bases have no cutters mounted thereon; this creates a stabilizer section especially desirable for milling casing in an uphole direction.

The lowermost or downhole ends of the cutter bases may comprise angled ends which facilitate entry of the tool into tubulars, milling/cutting/cleanout of tubulars, etc. The lower end of the main body may be pointed to ease entry into tubulars, partially obstructed bores, etc.

It can be readily understood that by the pin-type positive connection (or the gear arrangement connection) between the operating piston and the operating arms, that movement of the operating piston whether uphole or downhole always results in corresponding rotation of the operating arms either outwardly or inwardly (uphole movement of the piston resulting in inward rotation/movement of the operating arms; downhole movement of the piston resulting in outward rotation/movement of the operating arms). Further, it can be readily understood that when the piston is moved in an uphole direction by the spring, which happens when fluid flow ceases, that the operating arms, and consequently the cutter bases and cutters, retract to a closed position. In this closed position, the outer diameter of the apparatus is less than the inner diameter of the tubular strings through which it is run, so that the apparatus can be freely moved therethrough and retrieved.

Reference is made to pending U.S. application Ser. No. 14/420,612, owned by the applicant of this application, the disclosure of which is incorporated herein to the extent necessary to provide further background on the structure of the instant invention.

In another embodiment, the piston comprises a locking mechanism which locks the piston in its lowermost or downhole position, where the operating arms and cutter bases are extended, so that downward force on the operating arms and/or cutters/cutter bases (and/or force from the spring) cannot cause retraction of the cutter bases. This keeps the apparatus in its full operating position. In one embodiment, the piston locking mechanism comprises a modified piston assembly. The piston comprises an enlarged chamber at its upper end, wherein a piston releasing sleeve is releasably fixed by means of a shear pin or similar means. The piston releasing sleeve has a ball seat and a bore therethrough. A jet is preferably positioned in the bore of the piston below the chamber, to control fluid flow through the bore. One or more dogs are rotatably fixed to the piston, each of which has an upper and a lower end, such that one end (namely, an upper end) can rotate outwardly (typically under a spring bias), beyond the outer diameter of the piston, while the other end of the dogs extend into the piston chamber. When the piston is moved (by fluid flow) to its lowermost position, the dogs toggle outwardly and the upper ends engage a recess in the bore of the main body, locking the piston in that position.

To retrieve the apparatus, it is necessary to release the piston, and thereby allow the piston to move upward, and the operating arms/cutter bases to move to their retracted position. A suitably sized ball is released down the workstring bore, which seats on the ball seat and seals thereon. Continued pressure shears the shear pin holding the piston releasing sleeve in place, forcing it down into the piston chamber. The piston releasing sleeve forces the lower ends of the dogs radially outward, rotating the upper locking ends out of engagement with the recesses in the main body bore. The piston can then move upwardly in response to the spring bias, and the operating arms/cutter bases move to their retracted position. The tool can then be pulled up through the bore of the workstring and retrieved

DESCRIPTION OF THE PRESENTLY PREFERRED EMBODIMENT(S)

While various apparatus can embody the principles of the present invention, with reference to the drawings some of the presently preferred embodiments can be described.

Figure 1:
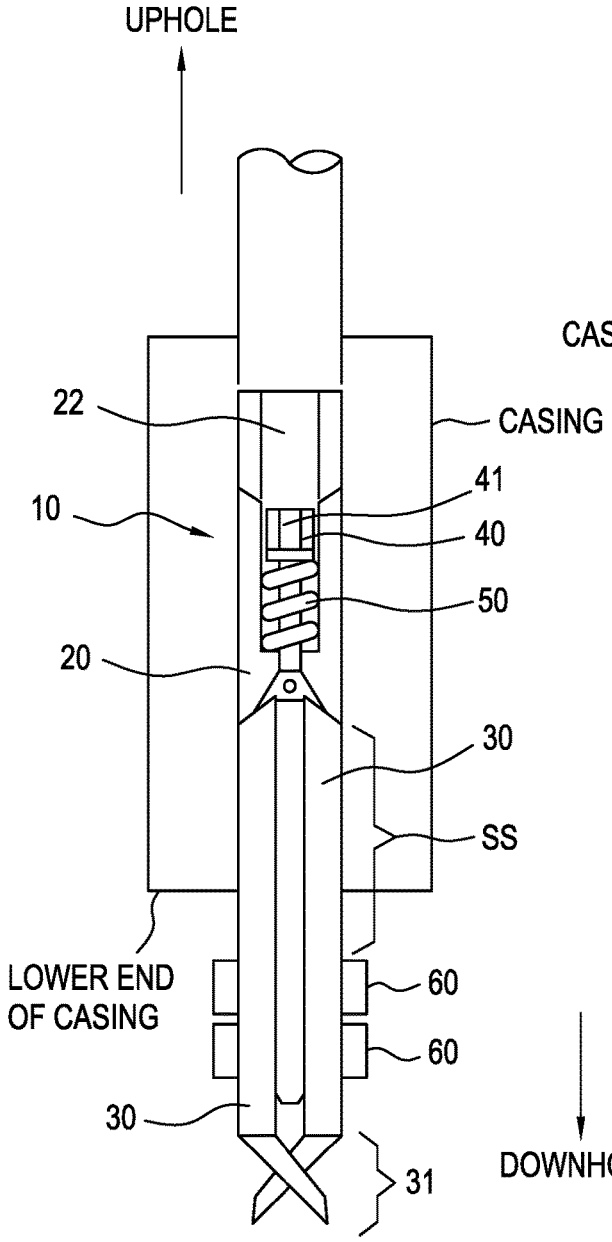
FIG. 1 is a side view in partial cross section of the apparatus, with the piston in an uphole position and the cutter bases in a first, closed position.
Figure 2:
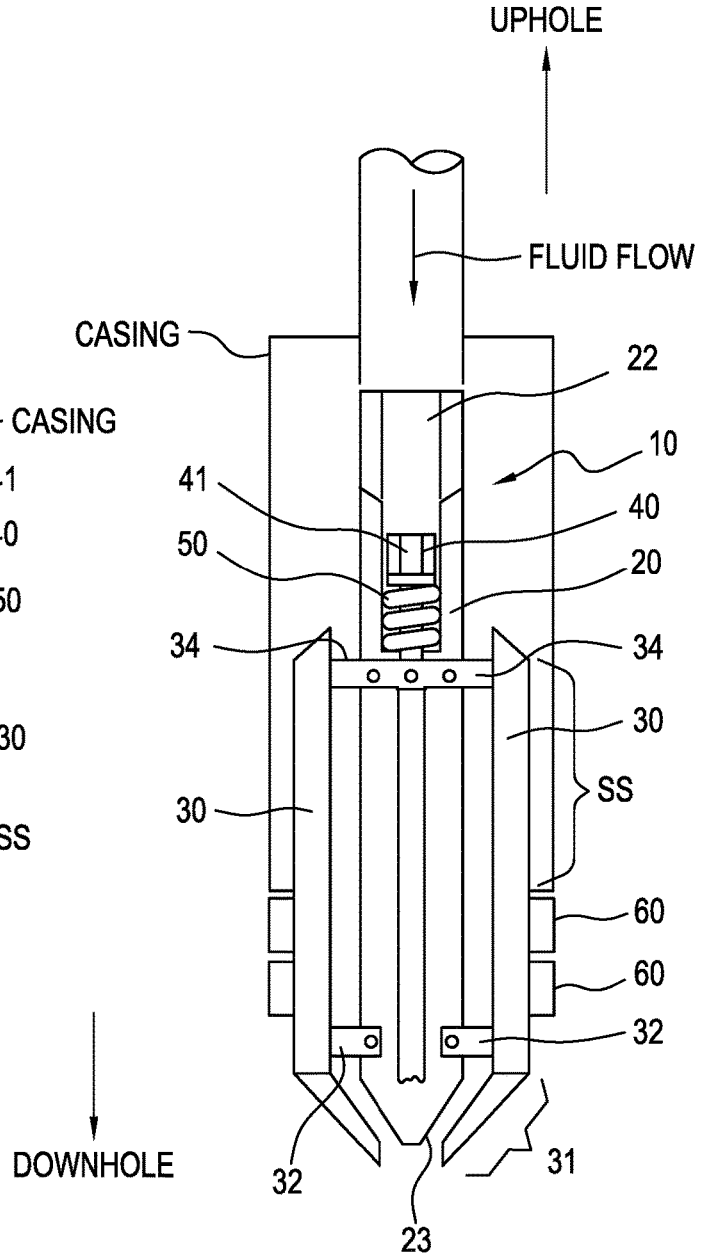
FIG. 2 is a side view in partial cross section of the apparatus, with the piston in an downhole position and the cutter bases in a second, open position.

As can be seen in FIGS. 1 and 2, apparatus 10 comprises a main body 20, which is generally elongated with a longitudinal bore 22 therethrough. Main body 20 comprises a means for attachment to a tubular string, which may be a coil tubing string, at its upper or uphole end. Uphole/downhole relative direction and orientation is noted on the drawings.

A plurality of cutter bases 30 are hingedly attached to main body 20 by a plurality of link arms 32, the uppermost of which comprises a plurality of operating arms 34 as will be later described. As readily understood from the drawings, link arms 32 and operating arms 34 are preferably of substantially equal length, so that cutter bases 30 are substantially parallel to main body 20, as cutter bases 30 move from a first, substantially retracted position as in FIG. 1, to a second, substantially extended position as in FIG. 2. Preferably cutter bases 30 have angled lower ends 31 covered with hardened cutting surfaces, to clean out metal, cement, etc. which may be encountered. Lower end 23 of main body 20 may be pointed.

A piston 40 is disposed in bore 22 of main body 20. Piston 40 is slidably disposed, and is biased in an uphole or upward direction by spring 50. Piston 40 is connected to operating arms 34 by a pinned connection, as seen in FIG. 2, whereby operating arms 34 can rotate relative to piston 40, but as is readily understood movement of piston 34 necessarily results in rotation of operating arms 34 inwardly (as the piston moves uphole) or outwardly (as the piston moves downhole).

Piston 40 has a central longitudinal bore 41. An interchangeable jet 48 may be provided to control fluid flow through bore 41. A seal 42 may be provided between piston 40 and bore 22. Fluid pumped down the coiled tubing string, and through bore 22 of main body 20, and the bore of piston 40, at a sufficient rate, will overcome the force exerted by spring 50 and force piston 40 downhole. As described, this will in turn rotate operating arms 34 outwardly, causing cutter bases 30 to move radially outward. When fluid flow ceases, spring 50 moves piston 40 uphole, and cutter bases 30 are moved to their first position as in FIG. 1.

A plurality of cutters 60 are mounted on cutter bases 30, spaced in a desired pattern. Preferably, cutters 60 are covered with a hardened cutting material to enable efficient cutting/milling of tubulars. Preferably, a section on cutter bases 30, denoted as stabilizer section "SS" in the figures, generally at an upper or uphole end of the cutter bases, has no cutters mounted thereon, providing a stabilizer section as will be later described.

Figure 4:
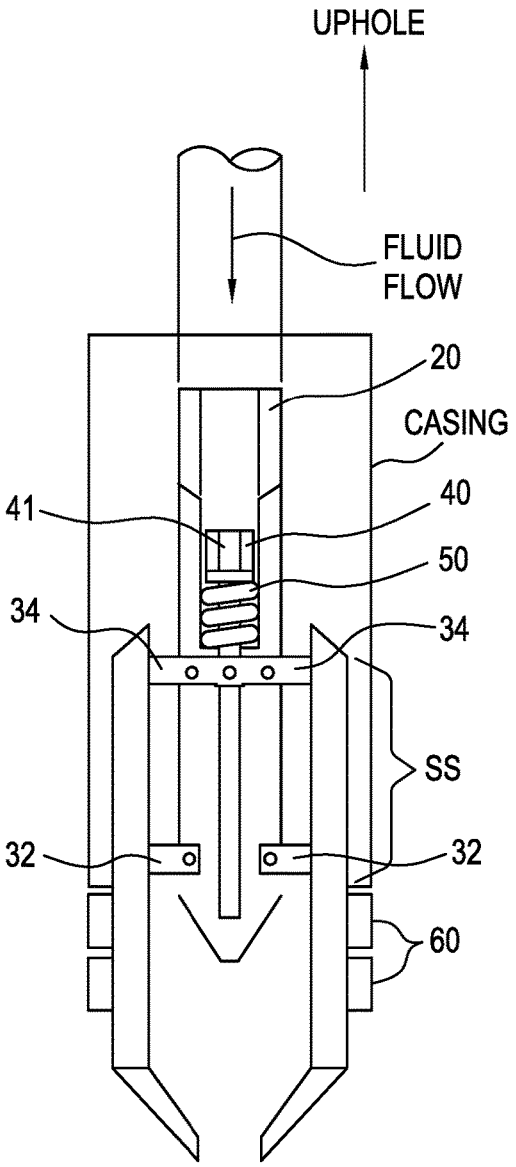
FIG. 4 shows another embodiment of the apparatus, in an open position.

FIG. 4 shows another embodiment of the apparatus in an open (cutting) position, with dimensions changed so as to yield a larger area between the end of main body 20 and cutter bases 30.

Figure 5:
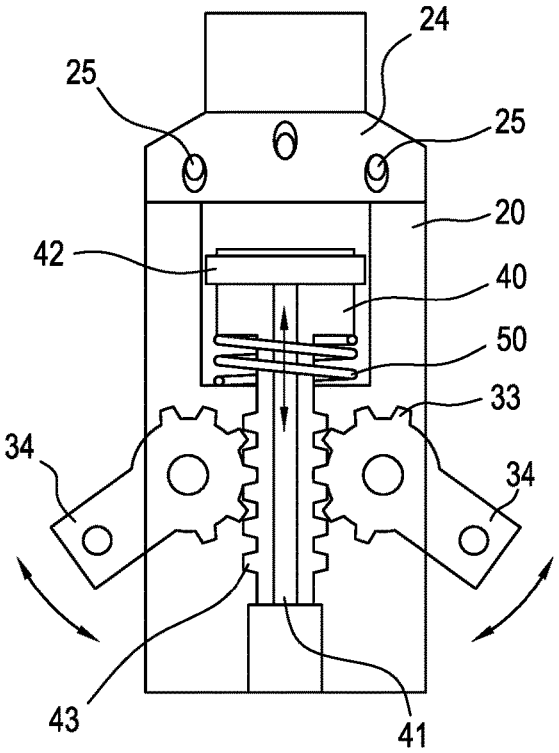
FIG. 5 shows a gear type connection between the piston and the operating arms.

FIG. 5 shows an embodiment of the present invention comprising a geared connection between piston 40 and operating arms 34. Gear teeth 43 on piston 40 engage gear teeth 33 on operating arms 32, such that movement upwardly and downwardly of piston 40 necessarily results in rotation of operating arms 34 inwardly and outwardly, as indicated by the arrows in FIG. 5. Note also the provision for a jetted sub 24 comprising jets 25, positioned above main body 20. Jets 25 permit diverting some portion of the total fluid flow into the annulus.

Use of the Apparatus

An exemplary use of the apparatus can now be described, with reference to the drawings. Although use is described in connection with coiled tubing as the workstring, it is understood that jointed tubulars can also be used as the workstring.

Referring to FIG. 1, apparatus 10 is shown with cutter bases 30 in their first, substantially retracted position. Piston 40 is biased to an uphole position by spring 50, and operating arms 34 and cutter bases 30 are necessarily retracted. Apparatus 10 is attached to the end of a coiled tubing string as the workstring (shown) and run into a wellbore, and positioned typically as shown in FIG. 1, with cutters 60 below a lower end of a previously cut casing string, and with the stabilizer section SS positioned within the casing string.

Figure 3:
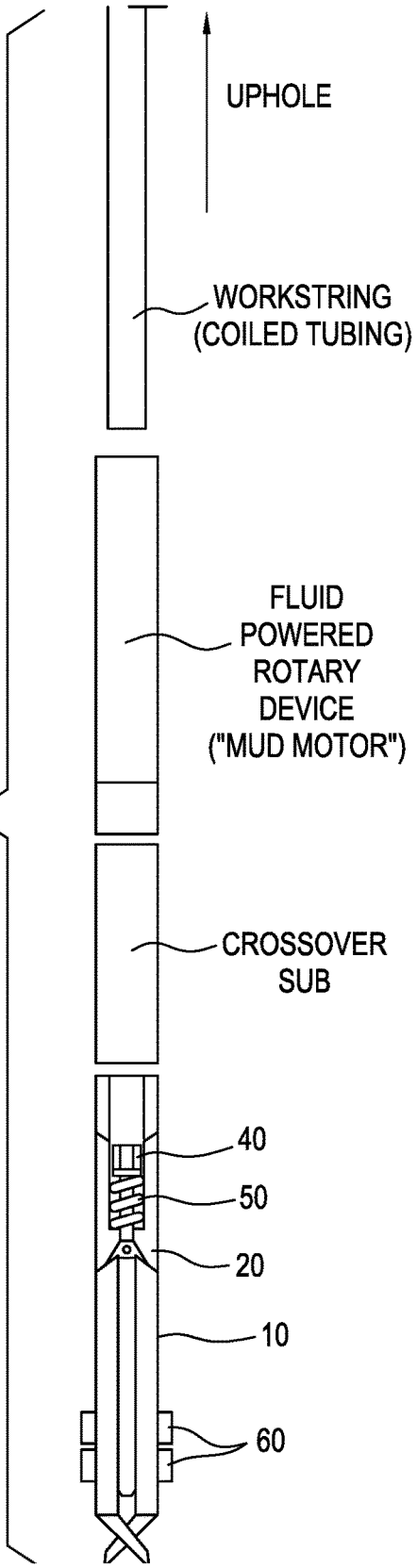
FIG. 3 shows an exemplary bottom hole assembly comprising the apparatus on the bottom, a cross over sub, and a mud motor, connected as shown to a workstring, for example a coiled tubing string.

In FIG. 2, fluid circulation down the bore of the coiled tubing string has started, as indicated by the arrows, overcoming the uphole force from spring 50 and pushing piston 40 downhole. By the pin connection (or alternatively the geared connection) between piston 40 and operating arms 34, operating arms 34 are rotated outwardly, moving cutter bases 30 to their second, open position, with the stabilizer section SS of cutter bases 34 bearing against the inner wall of the casing string. Apparatus 10 is then pulled sufficiently uphole that cutters 60 contact the lower end of the casing string. Apparatus 10 is then rotated, for example by a mud motor downhole (see the exemplary bottomhole assembly shown in FIG. 3), while tension is applied to the coiled tubing and cutters 60 bear against and cut/mill the lower end of the tubing. FIG. 3 shows an exemplary bottomhole arrangement of apparatus 10, a crossover sub 12, and a downhole mud motor 14, for example a positive displacement mud motor. The mud motor may be arranged for left hand (counterclockwise) rotation, as are the appropriate downhole threaded connections, to avoid backing off the threaded connections of the casing string being milled. It is understood that any type of fluid powered rotary device may be used, including positive displacement motors ("mud motors"), turbines, or other suitable rotary devices. It is further understood that the apparatus may be used on workstrings rotated from the surface, by the rotary of a drilling/workover rig, power swivel, etc.

An Embodiment Comprising a Piston Locking Mechanism

As can be readily understood from the foregoing description, when the apparatus is cutting in an upward direction (namely, being pulled upward by the coiled tubing, and thus pulled upward into the lowermost end of the cut casing string), the forces on the cutter bases/cutters tend to push them downward, thus tending to rotate the operating and link arms toward their retracted position, and to force the piston upward, thereby collapsing the apparatus. The force exerted on the piston by the fluid flow is what resists this movement.

Figure 6:
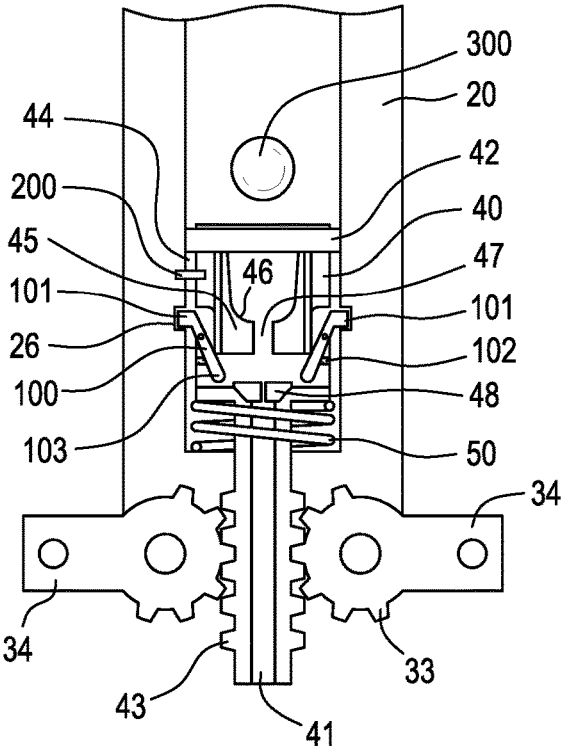
FIG. 6 shows another embodiment of the apparatus, with a piston locking mechanism.
Figure 7:
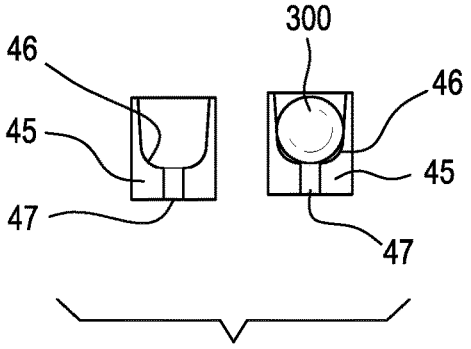
FIG. 7 is a detailed view of the releasing sleeve seen in FIG. 6.

In another embodiment shown in FIG. 6, with further detail in FIG. 7, the apparatus comprises a piston locking mechanism which positively locks the piston in its downward position, in turn locking the operating and link arms in their outward position, and the cutter bases/cutters in their outer position.

Referring to FIGS. 6 and 7, piston 40 comprises a chamber 44 at its upper end, above bore 41. Piston releasing sleeve 45 is releasably fixed in chamber 44 by means of a shear pin 200 or similar means. Piston releasing sleeve 45 has a ball seat 46 and a bore 47 therethrough, as can be seen in FIG. 6 and in more detail in FIG. 7. A jet 48 with a suitably sized hole therethrough is preferably positioned in the bore of the piston below the chamber, to control fluid flow through the bore. One or more dogs 100 are rotatably fixed to the piston, such that one end 101 (namely, an upper end) can rotate outwardly (typically under a spring bias, see exemplary spring 102 shown in schematical form), beyond the outer diameter of piston 40, while the other (lower) end 103 of the dogs extend into piston chamber 44. When piston 40 is moved (by fluid flow) to its lowermost position, dogs 100 (under influence of spring 102) toggle outwardly and engage recess 26 in bore 22 of main body 20, locking piston 40 in that lowermost position.

Figure 8:
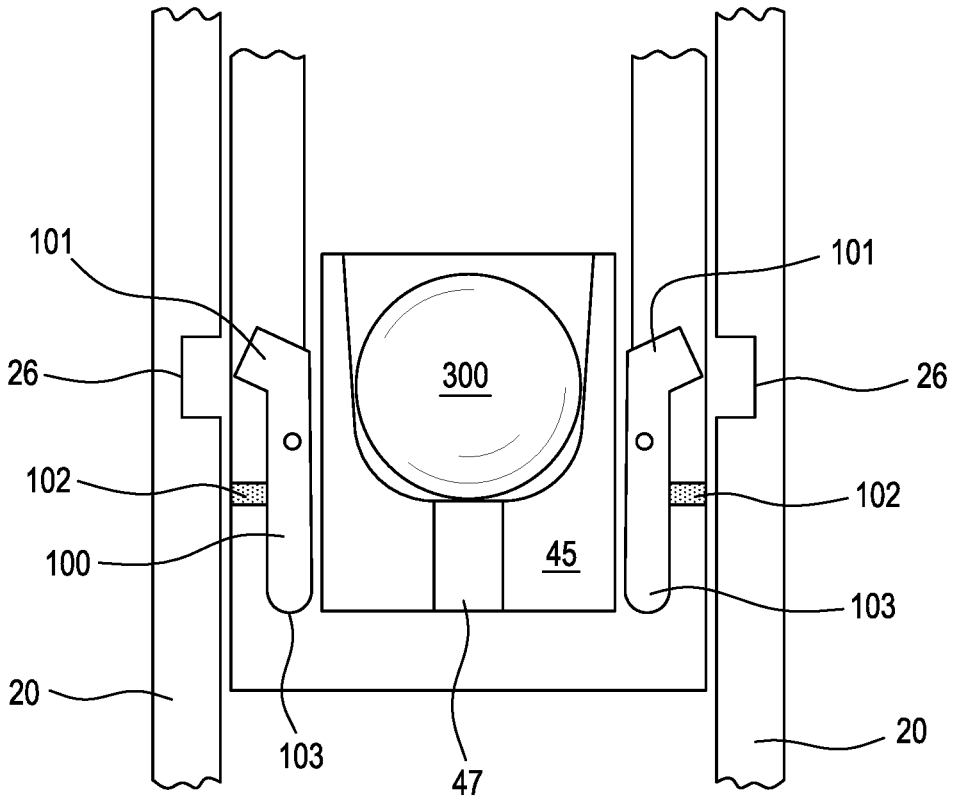
FIG. 8 shows the releasing sleeve in its lower position.

To retrieve apparatus 10, it is necessary to release piston 40, allow the piston 40 to move upward in response to spring 50 (and/or force applied to cutter bases 30/cutters 60 by pulling upward into the casing), and operating arms 34/cutter bases 30 to move to their retracted position. To do so, a suitably sized ball 300 is released down the workstring bore, ball 300 ultimately seating on ball seat 46 and sealing thereon. Continued pressure shears shear pin 200 holding piston releasing sleeve 45 in place, forcing it downwardly in piston chamber 44. This movement of piston releasing sleeve 45 forces the lower ends 103 of dogs 100 radially outward, rotating locking ends 101 out of engagement with recess 26 in main body bore 22. Piston 40 then moves upwardly in response to the bias from spring 50, and the operating arms/cutter bases move to their retracted position. The tool can then be pulled up through the bore of the workstring and retrieved. FIG. 8 shows releasing sleeve 45 in its lowermost position, pushing the lower ends 103 of dogs 100 and rotating the upper ends 101 out of engagement with recess 26, thereby unlocking the mechanism.

Release or Disconnect Mechanism

In the event that the apparatus cannot be retrieved through the bore of the workstring (e.g. in the event that the operating arms/cutter bases are lodged in an open position), the scope of the invention further comprises a release mechanism, which may be employed in this instance to release the apparatus from the workstring. While different mechanisms may serve this purpose and are included within the scope of the invention, a hydraulic release or disconnect, various types of which are known in the relevant art, may be added to the assembly.

Materials, Methods of Fabrication

Materials suitable for the present invention are those well known in the relevant field, including high strength metals and alloys thereof, and resilient elements for seals and the like. Fabrication and assembly of the apparatus may be by processes well known in the relevant art.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof.

Therefore, the scope of the invention is to be determined not by the illustrative examples set forth above, but by the appended claims and their legal equivalents.

I claim:

1. An apparatus for cutting and milling of downhole tubulars in a wellbore, comprising:

an elongated main body having an elongated bore therethrough, and adapted for connecting to a workstring;

a piston slidably disposed in said main body bore and movable between a first, upper position and a second, lower position, said piston having a longitudinal bore therethrough, and a spring disposed in said main body bore and biasing said piston toward said first, upper position;

a plurality of operating arms rotatably connected to said main body;

a plurality of cutter bases connected to said operating arms, and one or more cutters attached to each of said plurality of cutter bases;

wherein the plurality of operating arms, the plurality of cutter bases and the one or more cutters are movable between a first, retracted position and a second, extended position, said operating arms operatively connected to said piston so that when said piston is in said upper position, said operating arms, the plurality of cutter bases and the one or more cutters are forced to said first retracted position, and when said piston is in said lower position, said operating arms, the plurality of cutter bases and one or more cutters are forced to said second extended position; and one or more link members connecting each of said plurality of cutter bases to said main body, whereby each of said plurality of cutter bases is maintained substantially parallel to said main body in each of said first and second positions.

2. The apparatus of claim 1, wherein an upper section of each of said cutter bases has no cutters mounted thereon, forming a stabilizer section.

3. The apparatus of claim 2, whereby said piston is connected to said operating arms by a pinned connection.

4. The apparatus of claim 2, whereby said piston is connected to said operating arms by a toothed gear.

5. The apparatus of claim 1, further comprising a piston locking mechanism for locking said piston in said lower position, whereby said operating arms are locked in their second, extended position.

6. The apparatus of claim 5, whereby said piston locking mechanism comprises:

said piston comprising a chamber disposed above said piston bore, with a releasing sleeve slidably disposed in said chamber and releasably fixed within same chamber, said releasing sleeve comprising a ball seat therein and a bore therethrough;

one or more dogs rotatably mounted in said piston, each of said dogs having an upper, locking end extendable beyond an outer diameter of said piston, and a lower end extending into said chamber, said dogs biased such that said locking end is biased radially outward and said lower end is biased radially inward, whereby when said piston is in its lowermost position and said releasing sleeve is in its uppermost position, said locking end engages a recess within said main body bore, and prevent said piston from moving from said lowermost position;

whereby when a suitably sized ball is dropped through said bore of said workstring and lands on said ball seat, fluid pressure applied to said ball shifts said releasing sleeve to its lowermost position, forcing said lower ends of said dogs outwardly and rotating said upper ends of said dogs inwardly and out of engagement with said recess, permitting said piston to move upwardly and said operating arms and cutter bases to retract.

7. A coiled tubing deployed tubular milling assembly, comprising:

a length of coiled tubing disposed in a wellbore;

a tubular milling apparatus attached to said coiled tubing and positioned at a desired depth in said wellbore, said tubular milling apparatus comprising:

an elongated main body having an elongated bore therethrough, and adapted for connecting to the length of coiled tubing;

a piston slidably disposed in said main body bore and movable between a first, upper position and a second, lower position, said piston having a longitudinal bore therethrough, and a spring disposed in said main body bore and biasing said piston toward said first, upper position;

a plurality of operating arms rotatably connected to said main body; and a plurality of cutter bases connected to said operating arms, and the one or more cutters attached to each of said plurality of cutter bases;

wherein the plurality of operating arms, the plurality of cutter bases and one or more cutters are movable between a first, retracted position and a second, extended position, said operating arms operatively connected to said piston so that when said piston is in said upper position, said operating arms, the plurality of cutter bases and the one or more cutters are forced to said first retracted position, and when said piston is in said lower position, said operating arms, the plurality of cutter bases and the one or more cutters are forced to said second extended position;

one or more link members connecting each of said plurality of cutter bases to said main body, whereby each of said plurality of cutter bases is maintained substantially parallel to said main body in each of said first and second positions; and a fluid powered rotary motor disposed between said coiled tubing and said tubular milling apparatus, whereby said tubular milling apparatus is rotated by said rotary motor with fluid flow therethrough.

8. The apparatus of claim 7, whereby said piston is connected to said operating arms by a pinned connection.

9. The apparatus of claim 7, whereby said piston is connected to said operating arms by a toothed gear.

10. The apparatus of claim 7, further comprising a piston locking mechanism for locking said piston in said lower position, whereby said operating arms are locked in their second, extended position.

11. The apparatus of claim 10, whereby said piston locking mechanism comprises:

said piston comprising a chamber disposed above said piston bore, with a releasing sleeve slidably disposed in said chamber and releasably fixed within same chamber, said releasing sleeve comprising a ball seat therein and a bore therethrough;

one or more dogs rotatably mounted in said piston, each of said dogs having an upper, locking end extendable beyond an outer diameter of said piston, and a lower end extending into said chamber, said dogs biased such that said locking end is biased radially outward and said lower end is biased radially inward, whereby when said piston is in its lowermost position and said releasing sleeve is in its uppermost position, said locking end engages a recess within said main body bore, and prevent said piston from moving from said lowermost position;

whereby when a suitably sized ball is dropped through said bore of said workstring and lands on said ball seat, fluid pressure applied to said ball shifts said releasing sleeve to its lowermost position, forcing said lower ends of said dogs outwardly and rotating said upper ends of said dogs inwardly and out of engagement with said recess, permitting said piston to move upwardly and said operating arms and cutter bases to retract.

12. A method for milling tubulars in a wellbore, comprising the steps of:

a) providing a tubular milling assembly comprising:

a fluid powered rotary motor;

a tubular milling apparatus comprising:

an elongated main body having an elongated bore therethrough, and adapted to connecting to a workstring;

a piston slidably disposed in said main body bore and movable between a first, upper position and a second, lower position, said piston having a longitudinal bore therethrough, and a spring disposed in said main body bore and biasing said piston toward said first, upper position;

a plurality of operating arms rotatably connected to said main body; and a plurality of cutter bases connected to said operating arms, and one or more cutters attached to each of said plurality of cutter bases;

wherein the plurality of operating arms, the plurality of cutter bases and the one or more cutters are movable between a first, retracted position and a second, extended position, said operating arms operatively connected to said piston so that when said piston is in said upper position, said operating arms, the plurality of cutter bases and the one or more cutters are forced to said first retracted position, and when said piston is in said lower position, said operating arms, the plurality of cutter bases and the one or more cutters are forced to said second extended position; and one or more link members connecting each of said plurality of cutter bases to said main body, whereby each of said plurality of cutter bases is maintained substantially parallel to said main body in each of said first and second positions;

b) lowering said tubular milling assembly to a desired position in said wellbore, below a lower end of a tubular to be milled;

c) pumping fluid through said coiled tubing string and opening said apparatus;

d) lifting said cutting apparatus by said coiled tubing string so as to engage said lower end of said tubular, and maintaining fluid flow and tension on said apparatus.

* * * * *